US010537180B2

(12) United States Patent
Fletcher et al.

(10) Patent No.: US 10,537,180 B2
(45) Date of Patent: Jan. 21, 2020

(54) LOW PROFILE ROCKING CHAIR

(71) Applicant: Virco Mfg. Corporation, Torrance, CA (US)

(72) Inventors: Scott Lloyd Fletcher, Redondo Beach, CA (US); Man F. Hui, Monterey Park, CA (US); Peter Glass, Arroyo Grande, CA (US); Robert J. Mills, Torrance, CA (US); Douglas A. Virtue, San Pedro, CA (US); Sergio Rodriguez, Bellflower, CA (US)

(73) Assignee: Virco Mfg. Corporation, Torrance, CA (US)

( * ) Notice: Subject to any disclaimer, the term of this patent is extended or adjusted under 35 U.S.C. 154(b) by 0 days.

(21) Appl. No.: 15/934,885

(22) Filed: Mar. 23, 2018

(65) Prior Publication Data

US 2018/0271288 A1 Sep. 27, 2018

Related U.S. Application Data

(60) Provisional application No. 62/477,368, filed on Mar. 27, 2017, provisional application No. 62/503,731, filed on May 9, 2017.

(51) Int. Cl.

| | |
|---|---|
| ***A47C 3/02*** | (2006.01) |
| ***A47C 3/027*** | (2006.01) |
| ***A47C 3/029*** | (2006.01) |
| ***A47C 1/02*** | (2006.01) |
| ***A47C 3/12*** | (2006.01) |

(52) U.S. Cl.
CPC ..... *A47C 3/029* (2013.01); *A47C 1/02* (2013.01); *A47C 3/12* (2013.01)

(58) Field of Classification Search
CPC ..... A47C 3/029; A47C 1/02; A47C 3/12
USPC ..... 297/270.1, 271.6
See application file for complete search history.

(56) References Cited

U.S. PATENT DOCUMENTS 647,231 A * 4/1900 Kimball ..... A47C 3/029 297/272.2
888,387 A * 5/1908 Clemons ..... A47C 3/029 297/272.3

(Continued)

FOREIGN PATENT DOCUMENTS

EP 2206452 A2 * 7/2010 ..... A47C 3/029
GB 2502827 A * 12/2013 ..... A47C 3/029

*Primary Examiner* — Rodney B White
(74) *Attorney, Agent, or Firm* — Knobbe, Martens, Olson & Bear, LLP

(57) ABSTRACT

A chair having a seat portion that is capable of selectively moving between a rocking position and a stop position, the seat portion being joined to a bottom support comprising a rocking section, a flat section, and a transitional section, the rocking section having a defined curvature and extending between a front end of the bottom support component and the transitional section, the flat section having a substantially flat portion extending between a back end of the bottom support component and the transitional section, in the rocking position the chair is movable along the defined curvature of the rocking section, in the stop position the chair is configured to limit movement of the chair to the stop position, wherein the chair transitions between the rocking position and stop position by rotating past the transitional section of the bottom support.

13 Claims, 13 Drawing Sheets

(56) References Cited

U.S. PATENT DOCUMENTS 1,297,718 A * 3/1919 Mueller ..... A47C 3/029 297/271.6
1,301,639 A * 4/1919 Barker ..... A47C 3/029 297/271.6
1,317,580 A * 9/1919 Kanode ..... A47C 3/029 297/272.1
1,662,947 A * 3/1928 Banker ..... A47C 3/029 297/270.3
1,983,206 A * 12/1934 Witzel ..... A47C 3/029 297/270.1
1,983,207 A * 12/1934 Witzel ..... A47C 3/029 297/270.3
2,620,859 A * 12/1952 Kundtz ..... A47C 3/029 297/45
2,662,580 A * 12/1953 Gottfried ..... A47C 3/029 297/133
2,662,581 A * 12/1953 Gottfried ..... A47C 3/029 297/133
3,041,081 A * 6/1962 Lott ..... A47C 3/029 280/30
4,328,991 A * 5/1982 Mengshoel ..... A47C 3/029 297/271.1
4,595,234 A * 6/1986 Kjersem ..... A47C 9/002 297/271.6
4,786,105 A * 11/1988 Sheehan ..... A47C 3/029 297/271.6
5,375,911 A * 12/1994 Morrow ..... A47C 3/029 297/271.5
5,695,244 A * 12/1997 Gillern ..... A47C 3/029 297/271.6
6,000,750 A * 12/1999 Rossman ..... A47D 1/004 297/270.1 X
7,147,284 B2 * 12/2006 Mills ..... A47C 3/029 297/271.6 X
7,597,397 B2 * 10/2009 McCoy ..... A47C 3/18 297/271.6 X
7,621,592 B1 * 11/2009 Flannery ..... A47D 13/102 297/271.6 X
8,083,288 B1 * 12/2011 Warncke ..... A47C 3/20 297/134
8,585,136 B2 * 11/2013 Warncke ..... A47C 3/20 297/134
8,777,305 B1 * 7/2014 Jannetides ..... A47C 13/00 297/271.6 X
8,960,787 B2 * 2/2015 Warncke ..... A47C 3/20 297/271.6 X
9,668,583 B2 * 6/2017 Warncke ..... A47C 3/20
9,955,788 B1 * 5/2018 Montague ..... A47C 7/22
2011/0140492 A1 * 6/2011 Walsh ..... A47C 3/021 297/271.6
2017/0071347 A1 * 3/2017 Griggs, Jr. ..... A47C 3/029

* cited by examiner

LOW PROFILE ROCKING CHAIR

RELATED APPLICATIONS

Any and all applications for which a foreign or domestic priority claim is identified in the Application Data Sheet as filed with the present application are incorporated by reference under 37 CFR 1.57 and made a part of this specification.

BACKGROUND

Field of the Invention

The present disclosure generally relates to low profile chairs that comprise a seat supported by a rocking surface, wherein the seat is configured to be movable between a rocking position and a float position.

Description of the Related Art

Chairs are used in many different settings. In many cases, chairs fail to fit the needs of individuals in the particular setting in which they are used. In the classroom setting, for example, some chairs may fail to accommodate the natural movement of the child or student. Rather, such chairs are made for the child or student to sit up straight and still. Convenience plays a critical role in the way classroom chairs are made. In the classroom setting, chairs are made to be stackable. In some cases, a desire to maximize the stackability of classroom chairs limits the ability of chair makers to make chairs that optimize student comfort, health, and productivity.

Alternatives to chairs have been used to make up for the lacking comfort, health, and productivity benefits of existing chair designs. For example, balls, including yoga exercise balls, are sometimes used for seating purposes. Yoga exercise balls are used for seating purposes because they can accommodate the natural movement of the seated individual. However, yoga exercise ball chairs fail to provide the stability and back support desired in many seating applications.

SUMMARY OF CERTAIN EMBODIMENTS

Accordingly, a low profile rocking chair has been developed that includes features that permit rocking movement of the seat in one position, along with an option for rotating into a zero gravity position.

The methods and devices described herein have innovative aspects, no single one of which is indispensable or solely responsible for their desirable attributes. Without limiting the scope of the claims, some of the advantageous features will now be summarized.

In some embodiments the chair comprises a seat component including a seat portion with a bottom surface and a back support portion, the seat portion and the back support portion comprising a uniform body. The bottom support component can include a rigid layer, the rigid layer comprising a rocking section, a flat section, and a transitional section, the rocking section having a defined curvature and extending between a front end of the bottom support component and the transitional section, the flat section having a substantially flat portion extending between a back end of the bottom support component and the transitional section. The chair can include an intermediate support component joined to the seat component and comprising at least one support member, the at least one support member configured to interconnect the intermediate support with the seat component and the bottom support. The chair can be configured to be selectively movable between a rocking position and a stop position, in the rocking position the chair is movable along the defined curvature of the rocking section, in the stop position the chair is configured to limit movement of the chair to the stop position, wherein the chair transitions between the rocking position and stop position by rotating past the transitional section of the bottom support.

In some embodiments, the bottom support component further comprises a resilient layer covering at least a portion of the rigid layer, the resilient layer formed from a compressible material. In some embodiments, the resilient layer, in an uncompressed state, can be at least half of a total thickness of the rigid layer and the resilient layer.

In some embodiments, the chair can further comprise a coating layer covering at least a portion of the resilient layer. The coating layer can further comprise one or more elastomeric elements. In some embodiments the coating layer is an elastomeric material.

In some embodiments, the bottom support component is a unitary platform. In some embodiments, a thickness of the rigid layer can vary across the bottom support component.

In some embodiments, the intermediate support component and the rigid layer can be formed as a unitary body. In some embodiments, the bottom support can include a plurality of rails, each rail coupled to a corresponding support member of the intermediate support component, each rail comprising a rigid layer.

In some embodiments, the chair has a seat portion that is capable of selectively moving between a rocking position and a stop position, the seat portion being joined to a bottom support comprising a rocking section, a flat section, and a transitional section, the rocking section having a defined curvature and extending between a front end of the bottom support component and the transitional section, the flat section having a substantially flat portion extending between a back end of the bottom support component and the transitional section, in the rocking position the chair is movable along the defined curvature of the rocking section, in the stop position the chair is configured to limit movement of the chair to the stop position, wherein the chair transitions between the rocking position and stop position by rotating past the transitional section of the bottom support.

In some embodiments, the chair comprises an intermediate support component joined configured to join the seat portion to the bottom support.

In some embodiments, the bottom support further comprises a rigid layer and a resilient layer, the resilient layer formed of a compressible material and covering at least a portion of the rigid layer. In some embodiments, the chair further comprises a coating layer covering at least a portion of the resilient layer. In some embodiments, the coating layer further comprises one or more elastomeric elements.

BRIEF DESCRIPTION OF THE DRAWINGS

Throughout the drawings, reference numbers have been reused to indicate general correspondence between reference elements. The drawings are provided to illustrate an example embodiment described herein and are not intended to limit the scope of the disclosure.

DETAILED DESCRIPTION

Figure 1:
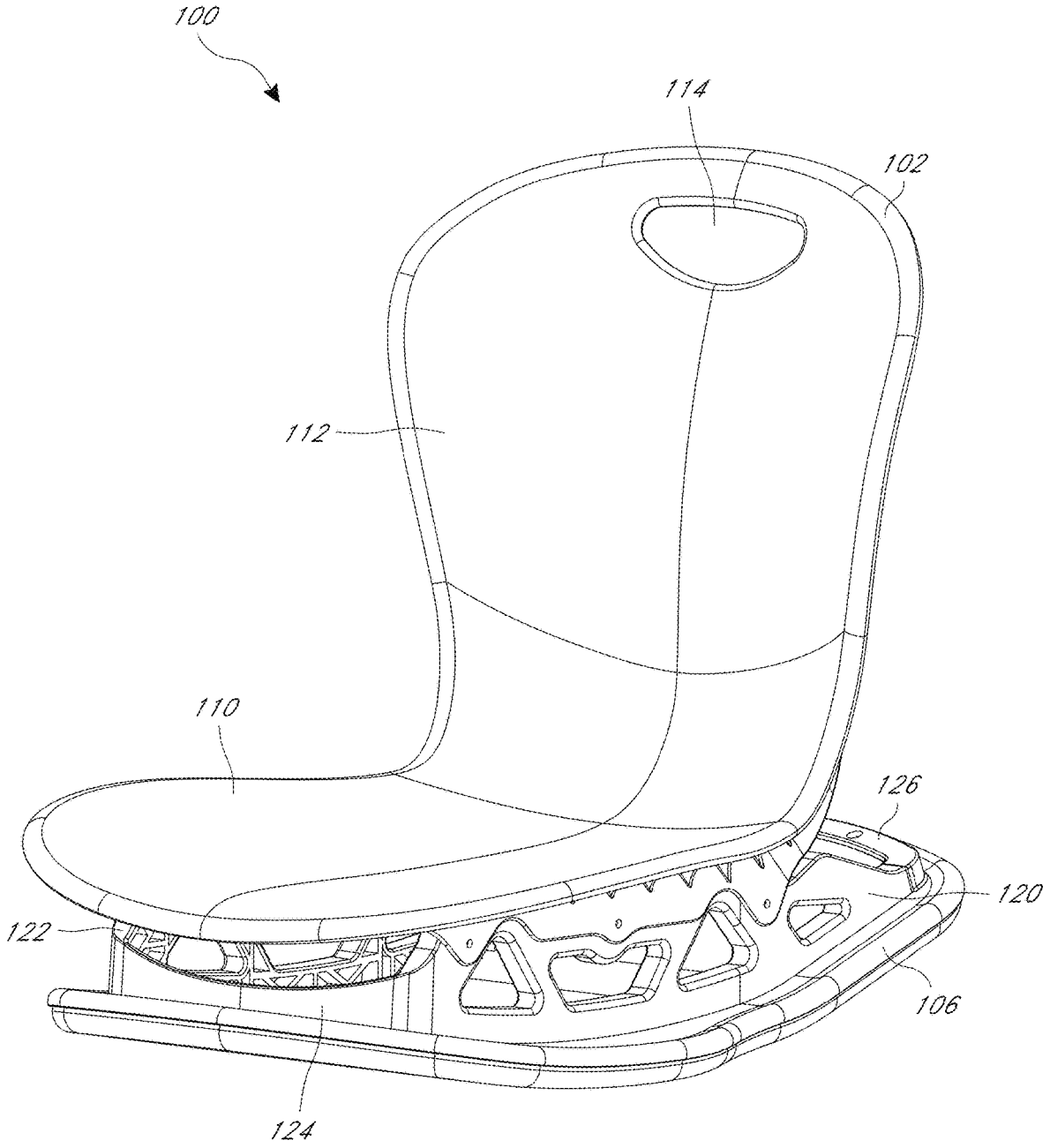
FIG. 1 is a front perspective view of a chair that is arranged and configured in accordance with certain features, aspects, and advantages of the present invention.
Figure 2:
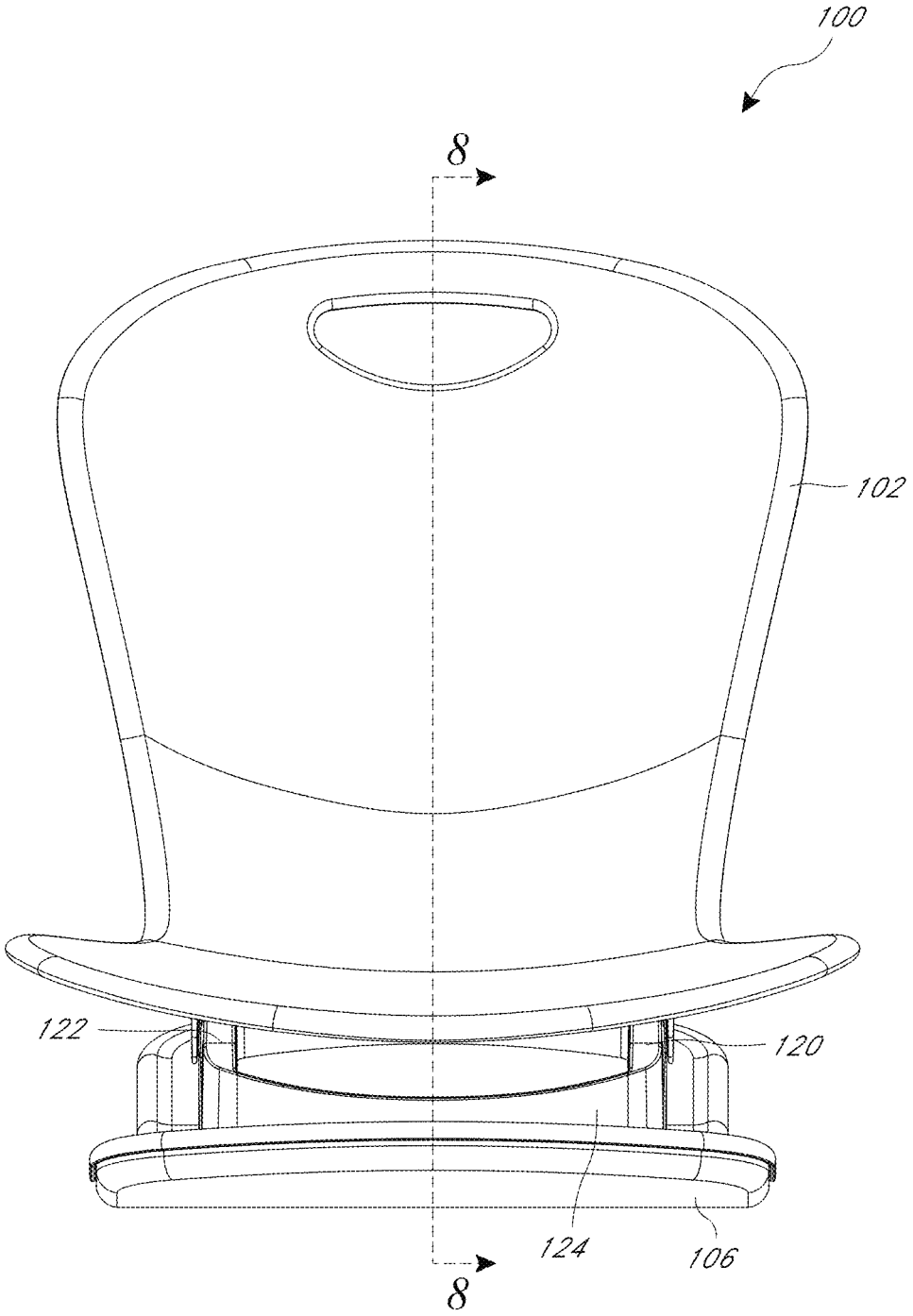
FIG. 2 is a front view of the chair of FIG. 1.
Figure 3:
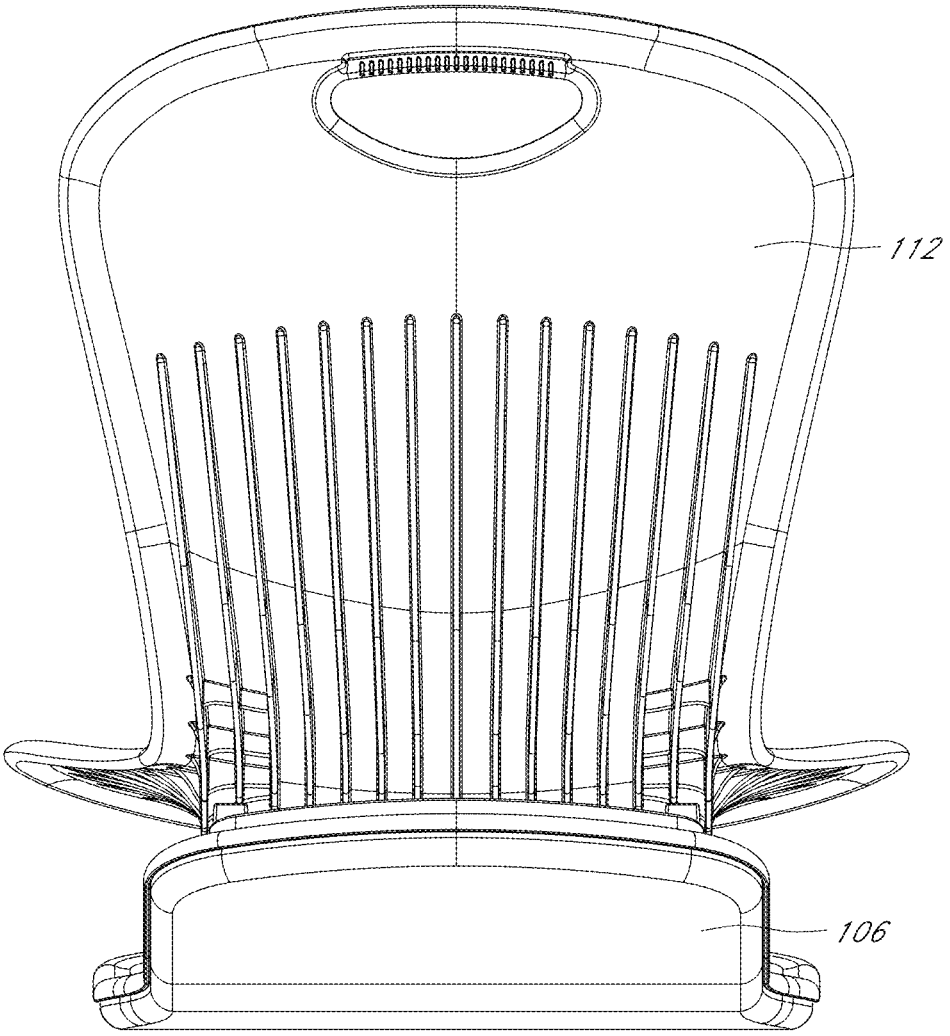
FIG. 3 is a rear view of the chair of FIG. 1.
Figure 4:
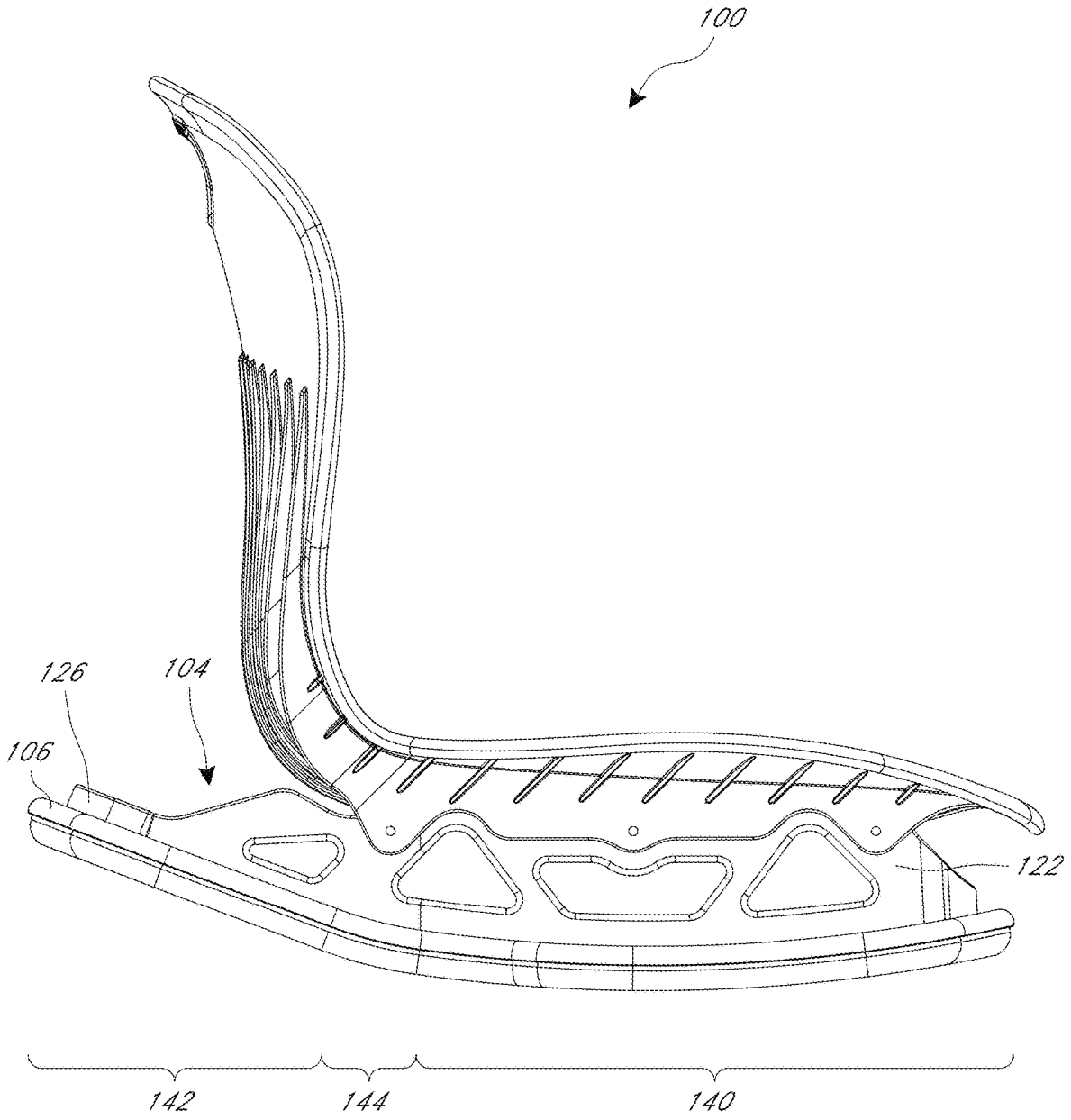
FIG. 4 is a right side view of the chair of FIG. 1.
Figure 5:
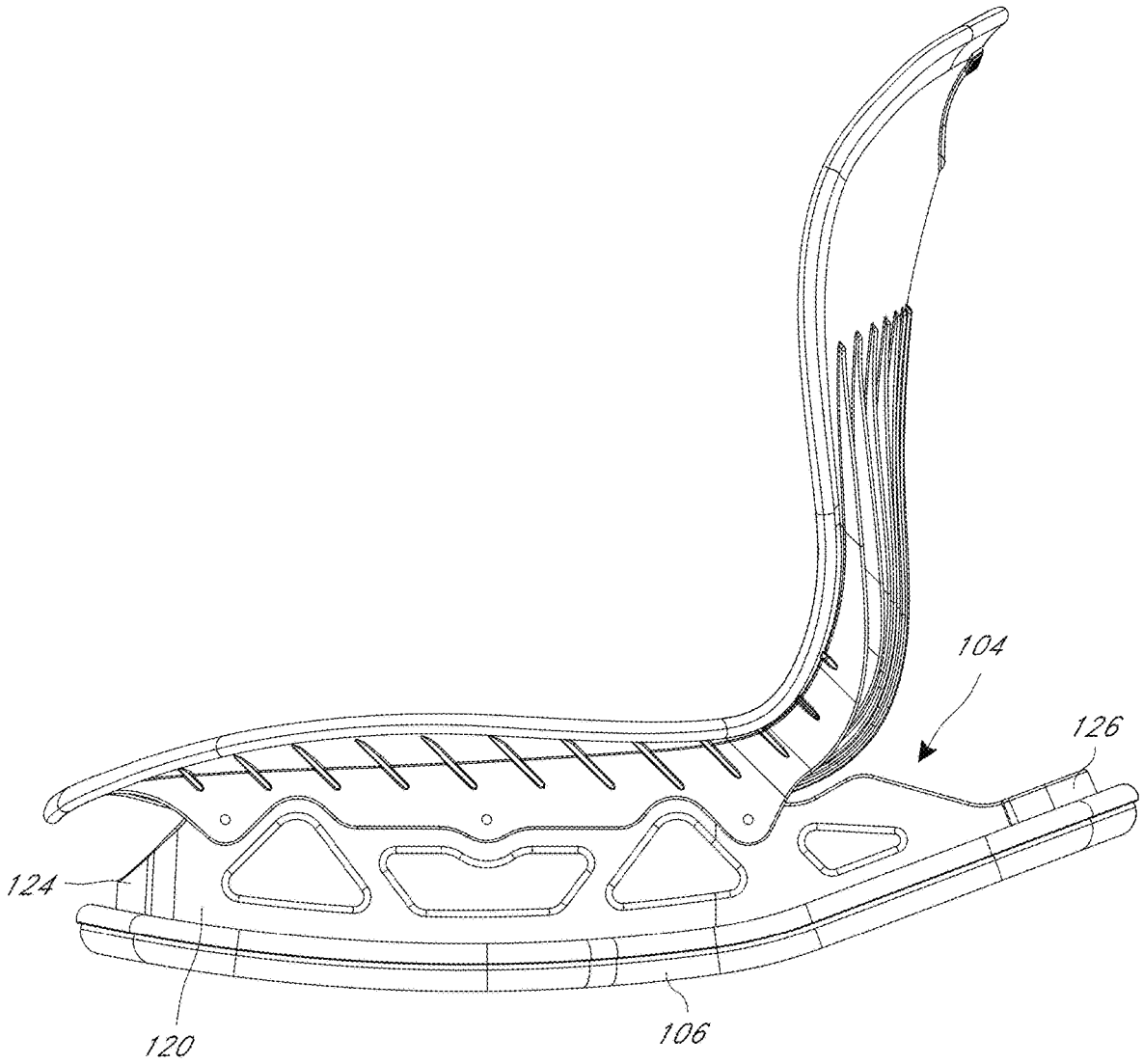
FIG. 5 is a left side view of the chair of FIG. 1.
Figure 6:
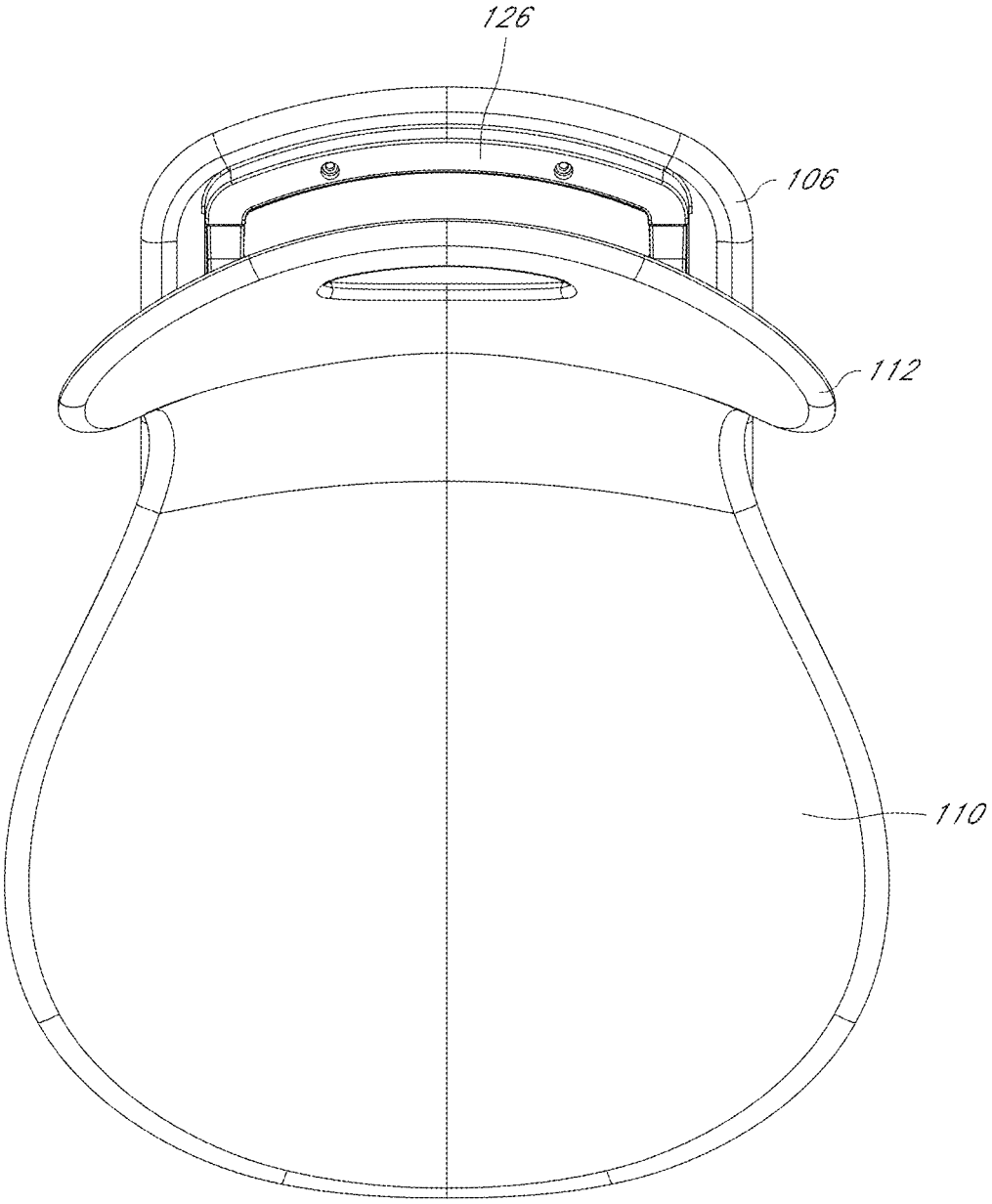
FIG. 6 is a top view of the chair of FIG. 1.
Figure 7:
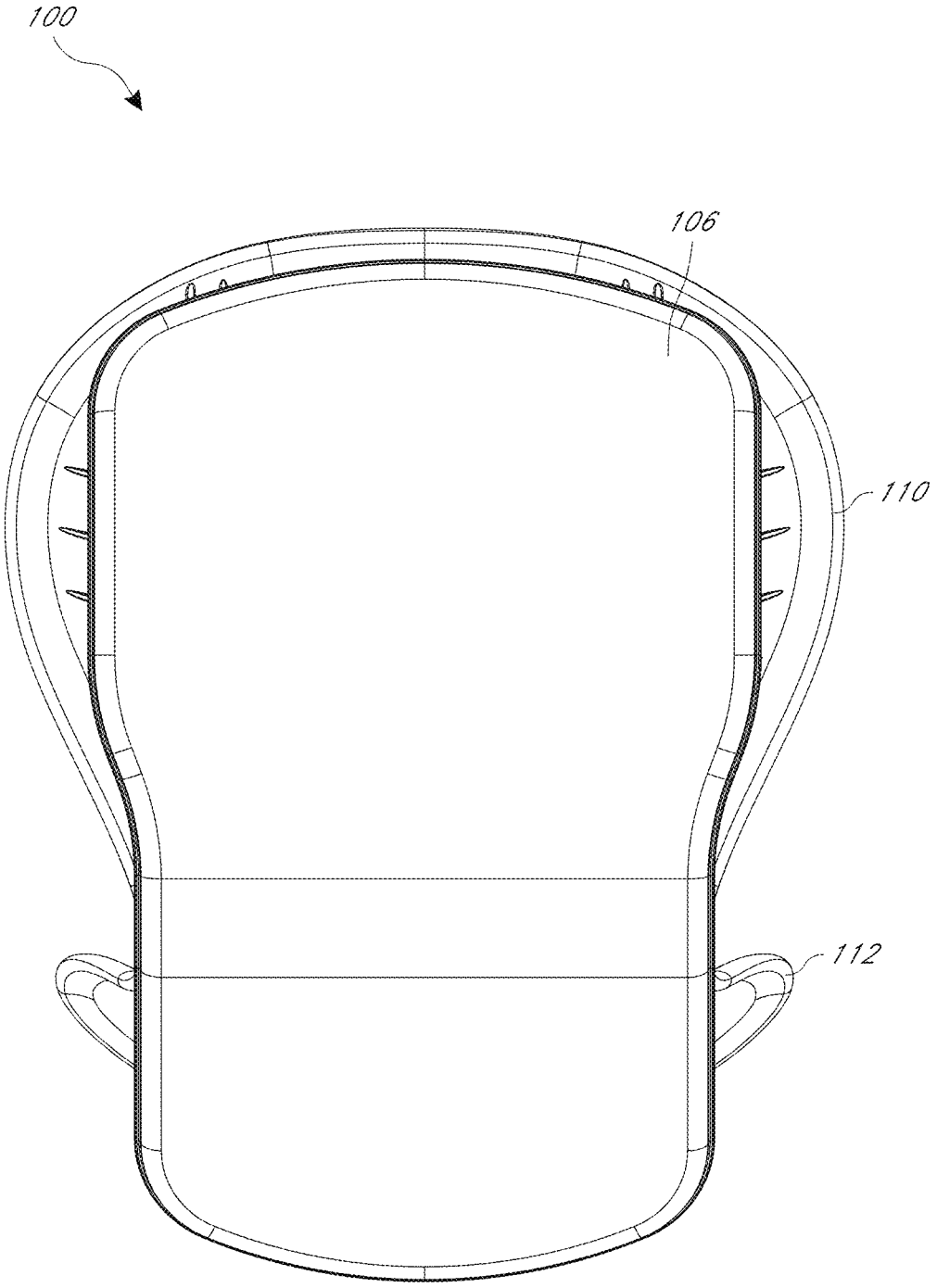
FIG. 7 is a bottom view of the chair of FIG. 1.
Figure 8:
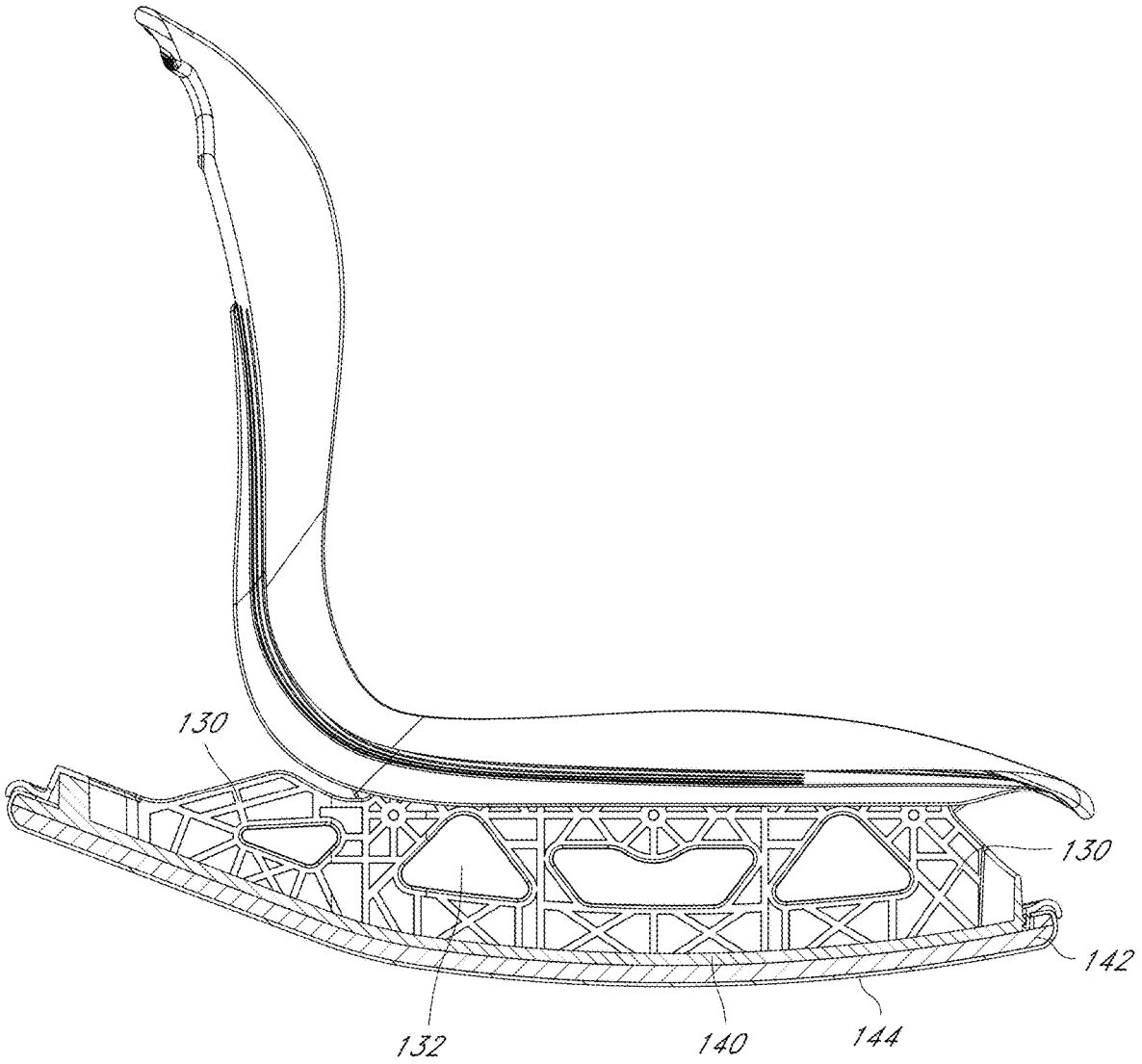
FIG. 8 is a right side cross-sectional view of the chair of FIG. 1 illustrating two of the bellows used with the motion control mechanism.

FIGS. 1-8 show various views of a chair 100 that is arranged and configured in accordance with certain features, aspects, and advantages of the present disclosure. In some embodiments, the chair 100 comprises three main components. In the illustrated embodiment, the chair 100 generally comprises a seat 102, an intermediate support 104, and a bottom support 106. The intermediate support 104 can interconnect or couple the seat 102 and the bottom support 106.

One or more of the three main components can be structured as a subassembly or module. As used herein, a module is a set of standardized parts or independent units that can be used to construct a more complex structure. In some embodiments, one or more of the modules can be used in other configurations. In some embodiments, the seat 102 can be a module that is usable in the assembly of other chairs and the bottom support 106 can be another module that is usable in the assembly of other chairs. The intermediate support 104 is a module that links the seat 102 and the bottom support 106 and can also be usable in other chairs. In some embodiments, one or more modules may be combined together, for example, the intermediate support 104 and the bottom support 106 may be combined into a single module.

The seat 102 generally comprises a seat portion 110 and a back support portion 112. The seat portion 110 and the back support portion 112 can be integrally formed as a monolithic structure as shown in the illustrated embodiment. In some embodiments, the back support portion 112 can be a component or subassembly that is separate of and distinct from the seat portion 110 and the seat 102 can be a module. In other words, the back support portion 112 can be separately formed relative to the seat portion 110 but the two can be connected together. In some such embodiments, the back support portion 112 and the seat portion 110 can be interconnected using one or more posts, frames, fasteners, or any other suitable structure. In some embodiments, the back support portion 112 comprises a handhold, one or more openings, or other suitable configurations that can define a handle 114. The handle 114 enables the chair 100 to be moved or carried away more easily.

The seat can have any suitable configuration. In some configurations, embodiments of the seat 102 can be configured as shown and described in any of the following patents, each of which is hereby incorporated by reference in its entirety: U.S. Design Pat. No. 742,153, issued on Nov. 3, 2015 and entitled Chair Seat; U.S. Design Pat. No. 730,095, issued on May 26, 2015 and entitled Desk; U.S. Design Pat. No. 686,439, issued Jul. 23, 2013 and entitled Chair Bucket; U.S. Design Pat. No. 686,032, issued Jul. 16, 2013 and entitled Chair; U.S. Design Pat. No. 686,860, issued Jul. 30, 2013 and entitled Chair with Curved Legs and Back Support; U.S. Design Pat. No. 686,859, issued Jul. 30, 2013 and entitled Chair with Curved Legs; U.S. Design Pat. No. 686,858, issued Jul. 30, 2013 and entitled Chair with Curved Legs and Back Support; U.S. Design Pat. No. 686,857, issued Jul. 30, 2013 and entitled Chair with Curved Legs; U.S. Design Pat. No. 564,768, issued Mar. 25, 2008 and entitled Task Chair; U.S. Design Pat. No. 547,980, issued Feb. 27, 2007 and entitled Chair Bucket; U.S. Design Pat. No. 547,979, issued Aug. 7, 2007 and entitled Chair Frame; U.S. Design Pat. No. 549,018, issued Aug. 21, 2007 and entitled Chair Bucket; U.S. Pat. No. 7,380,879, issued Jun. 3, 2008 and entitled Self-Leveling Furniture Leg Foot; U.S. Design Pat. No. 544,230, issued Jun. 12, 2007 and entitled Chair; U.S. Design Pat. No. 522,265, issued Jun. 6, 2006 and entitled Chair; U.S. Design Pat. No. 521,750, issued on May 30, 2006 and entitled Chair Desk Combination; U.S. Design Pat. No. 521,757, issued May 30, 2006 and entitled Chair; U.S. Design Pat. No. 521,751, issued on May 30, 2006 and entitled Chair Desk Combination; U.S. Design Pat. No. 521,283, issued May 23, 2006 and entitled Chair Seat; U.S. Design Pat. No. 520,782, issued May 16, 2006 and entitled Chair Back; U.S. Design Pat. No. 520,768, issued May 16, 2006 and entitled Chair; U.S. Design Pat. No. 523,265, issued on Jun. 20, 2006 and entitled Chair Desk Combination Frame; U.S. Design Pat. No. 513,892, issued on Jan. 31, 2006 and entitled Chair/Desk; U.S. Design Pat. No. 522,777, issued on Jun. 13, 2006 and entitled Chair Desk Combination Frame; U.S. Design Pat. No. 521,282, issued May 23, 2006 and entitled Chair Desk Combination Frame; U.S. Design Pat. No. 514,829, issued on Feb. 14, 2006 and entitled Chair/Desk; U.S. Design Pat. No. 542,039, issued on May 8, 2007 and entitled Chair/Desk; U.S. Pat. No. 7,059,670, issued on Jun. 13, 2006 and entitled Stackable Chair-Desk Frame; U.S. Design Pat. No. 514,339, issued Feb. 7, 2006 and entitled Task Chair; U.S. Design Pat. No. 507,893, issued Aug. 2, 2005 and entitled Stool; U.S. Design Pat. No. 504,026, issued Apr. 19, 2005 and entitled Task Chair; U.S. Design Pat. No. 513,911, issued Jan. 31, 2006 and entitled Chair Seating Assembly; U.S. Design Pat. No. 512,252, issued Dec. 6, 2005 and entitled Rocking Chair Carriage Assembly; U.S. Design Pat. No. 526,134, issued Aug. 8, 2004 and entitled Rocking Chair; U.S. Pat. No. 7,147,284, issued Dec. 12, 2006 and entitled Student Desk Chair with Rockers Rails; U.S. Design Pat. No. 503,559, issued Apr. 5, 2005 and entitled Chair; U.S. Design Pat. No. 507,890, issued on Aug. 2, 2005 and entitled Chair and Desk Combination; U.S. Design Pat. No. 505,022, issued May 17, 2005 and entitled Chair and Desk Combination; U.S. Design Pat. No. 499,260, issued Dec. 7, 2004 and entitled Chair; U.S. Design Pat. No. 488,630, issued Apr. 20, 2004 and entitled Stool; U.S. Design Pat. No. 461,348, issued Aug. 13, 2002 and entitled Chair Portion; U.S. Design Pat. No. 461,322, issued Aug. 13, 2002 and entitled Chair; U.S. Design Pat. No. 471,729, issued Mar. 18, 2003 and entitled Four-Legged Chair; U.S. Design Pat. No. 469,969, issued Feb. 11, 2003 and entitled Four-Legged Chair; U.S. Pat. No. 6,585,320, issued Jul. 1, 2003 and entitled Tilt Control Mechanism for a Tilt Back Chair; U.S. Design Pat. No. 469,284, issued Jan. 28, 2003 and entitled Chair; U.S. Design Pat. No. 469,265, issued Jan. 28, 2003 and entitled Chair; U.S. Pat. No. 6,533,352, issued Mar. 18, 2003 and entitled Chair with Reclining Back Rest; U.S. Design Pat.

No. 441,557, issued May 8, 2001 and entitled Lightweight Chair; U.S. Design Pat. No. 437,124, issued Feb. 6, 2001 and entitled Chair; U.S. Pat. No. 5,954,396, issued Sep. 21, 1999 and entitled Chair Construction; U.S. Design Pat. No. 417,342, issued Dec. 7, 1999 and entitled Chair with Tablet Arm; U.S. Design Pat. No. 414,618, issued Oct. 5, 1999 and entitled Sled-Base Chair; U.S. Pat. No. 5,924,770, issued Jul. 20, 1999 and entitled Chair Construction; U.S. Design Pat. No. 410,801, issued Jun. 8, 1999 and entitled Chair with Arm Rests; U.S. Pat. No. 6,003,948, issued Dec. 21, 1999 and entitled Chair Construction; U.S. Design Pat. No. 417, 969, issued Dec. 28, 1999 and entitled Chair Frame; U.S. Pat. No. 6,116,692, issued Sep. 12, 2000 and entitled Chair Construction; U.S. Pat. No. 4,768,833, issued Sep. 6, 1988 and entitled Chair Construction; U.S. Design Pat. No. 289, 235, issued Apr. 14, 1987 and entitled Chair; and U.S. Pat. No. 4,400,031, issued Aug. 23, 1983 and entitled Interlocking Chair.

The illustrated intermediate support 104 generally comprises a first support member 120, a second support member 122 a front support member 124, and a rear support member 126. The front support member 124 and the rear support member can connect to the first support member 120 and the second support member 122. The first support member 120, second support member 122, front support member 124 and rear support member 126 can be integrally formed as a monolithic structure as shown in the illustrated embodiment. In some embodiments, each support member 120, 122, 124, and 126 can be a component or subassembly that is separate of and distinct from the other members. In other words, the first support member 120, second support member 122, front support member 124, and rear support member 126 can each be formed separately, but the support members can be connected together. In some such embodiments, the support members 120, 122, 124, and 126 can be interconnected using one or more posts, frames, fasteners, or any other suitable structure. In some embodiments, the intermediate section 104 may not include front or rear support members 124, 126.

Upper portions of the first support member 120 and the second support member 122 can be attached to the seat portion 110. The first support member 120 and the second support member 122 can be rigidly attached to the seat portion 110. The first support member 120 and the second support member 122 can be attached to the seat portion 110 so that the first support member 120 and the second support member 122 are positioned underneath the seat portion 110. As illustrated, the ends of the first and second support members can extend beyond the seat 102. In some embodiments, the first and second support members can extend to substantially to the end of the seat 102

The intermediate support 104 can provide an interface between the seat 102 and the bottom support 104. The intermediate support is configured to couple the seat portion with the bottom portion at a defined height. The height of the seat 102 relative to the bottom support 106 may vary based on various factors, such as usage type, chair size, and/or other factors. For example, different types of seats 102 may require specific types of intermediate sections 104 that are used to couple the seat to the bottom support 106. The intermediate support 104 can be interconnected with the bottom support 106 section using one or more posts, frames, fasteners, or any other suitable structure. In some embodiments, at least a portion of the intermediate support 104 can be integrally formed with the bottom support 106 as a monolithic structure. In some embodiments, the intermediate support can be manufactured using injection molding.

The first support member 120 and the second support member 122 are horizontally spaced apart from each other. The first and second support members 120, 122 are preferably spaced apart such that the seat 102 has a stable base and is unlikely to topple laterally when a person is sitting in the seat portion 110. The intermediate portion 104 can be designed to include various structural supports. With specific reference to FIG. 8, the first and second support members 120, 122 include webbing 130 that can provide structural support for chair. The internal webbing can help to provide structural support to the intermediate section in order to help support the weight of a person that is moving and rocking the chair. The support members 120, 122 also can include cutouts of various shapes and sizes, which can be structural and/or ornamental in nature. In some embodiments, the intermediate support 104 can be replaced with more support member (e.g., 3 or more support members). In some embodiments, the chair may include a single support member that extends across a portion of the width of the chair. The intermediate support 104 may be formed from various types of supports (e.g., support struts, legs, etc.), and formed from various materials such as, metal, plastic, or other types of materials that provide sufficient strength to support a person sitting within the seat 100.

The bottom support 106 comprises a platform like structure that can include a rigid layer 140 and a resilient layer 142. The rigid layer 140 generally defines the shape and size of the bottom support 106. The rigid layer 140 can extend at least a portion of the thickness of the bottom support. In some embodiments, the rigid layer 140 can extend between ⅓ and ½ of the thickness of the bottom support 106. In some embodiment, the rigid layer is at least ¼ the thickness of the bottom support. In some embodiments, the thickness of the rigid layer varies. In some embodiments, for at least a portion of the bottom support 106, the rigid layer 140 can extend the entire thickness of the bottom support 106. As described above, the intermediate support 104 can be interconnected with the rigid layer 140 of the bottom support 106 using one or more posts, frames, fasteners, or any other suitable structure. In some embodiments, at least a portion of the intermediate support 104 can be integrally formed with the rigid layer 140 of the bottom support 106 as a monolithic structure. The rigid layer 140 can be constructed from the same or different materials than those used for the intermediate support 104. In some embodiments, instead of a platform structure, the bottom portion 106 can be divided into a plurality of sections. For example, the bottom support 106 may comprise two or more rails, with each rail mounted to a support member of the intermediate support (such as, the first support member 120 and the second support member 122). As illustrated, the frontward portion can have a greater width that the rearward portion of the bottom portion 106.

The resilient layer 142 can be positioned to cover at least a portion of the rigid layer 140. The resilient layer 142 can be formed from a non-rigid compressible material, such as an open or closed cell foam material, neoprene, or other types of compressible materials. While the discussion resilient layer will be in the context of a foam, specifically a compressible foam, it will be noted that other compressible materials can be used in the same or similar fashion. The use of foam is believed to advantageously provide sufficient support and the desired movement while helping to reduce the amount of force applied to objects positioned under the chair during usage when compared to the use of at least some of the alternative structures that can be used. In addition, as mentioned above, the use of foam can provide a desired amount of compressibility, which can soften or dampen the force applied to an object positioned under the bottom support 106 during usage of the chair. The foam can formed of a material having a density between 2 to 8 lbs/ft$^3$. The foam, however, can be made of other materials taking into account the desired characteristics and anticipated environment of use. In some embodiments, the resilient layer 142 can be formed using an bladder, that can be filled with a gas (such as, for example, air, nitrogen, and so forth) or fluid (such as, water, a gel substance, and the like). The bladder can be inflated or filled so that it has a defined pressure and/or density. In some embodiments, the bladder can be partitioned into a plurality of closed compartments.

In some embodiments, the resilient layer 142 can extend ½ to ⅔ of the thickness of the bottom support 106. In some embodiments, the resilient layer 142 can extend ¼ to ¾ of the thickness of the bottom support 106. In some embodiments, the resilient layer 142 can be molded and formed to fit over the rigid layer 140. The resilient layer 142 can be positioned to cover at only a portion of the rigid layer 140. In some embodiments, the entirety of the portion of the bottom support 106 that would be in contact with the floor can be covered by the resilient layer 142. In some embodiments, the bottom and the sides of the rigid layer are covered by the resilient layer. The resilient layer can be affixed to the rigid layer using an adhesive or other suitable method.

In some embodiments, the bottom support 106 can also include a coating layer 144, also referred to a protective layer. In coating layer 144 may cover at least a portion of the resilient layer 142 and the rigid layer 140. The coating layer 144 can help protect the resilient layer 142 from damage during normal operation. Additionally it can help to prevent the resilient layer 142 from being damaged by pulling pieces of the softer resilient layer while using the chair. The coating layer 144 can be an elastomeric material, PVC, or other coating material. The coating layer 144 can be configured to provide increased durability without significantly affecting the compressibility of the resilient material. In some embodiments, the coating layer 144 can include a plurality of elastomeric portions. The elastomeric portions can help to prevent the chair from moving laterally, such as slipping and sliding, while not interfering with the back and forth rocking motion of the chair 100. In some embodiments, the entire coating layer 144 may be formed from an elastomeric non-slip material.

The bottom support 106 is configured to provide controlled movement between a rocking position and a flat position (also referred to as a stop position or float position). The bottom support 106 can generally be divided between a rocker portion 140, a flat portion 142, and a transitional portion 144. The transitional portion 144 generally refers to the area where the rocker portion 140 and the flat portion 142 merge. The transitional portion 144 can also be referred to as the pivot point. The rocker portion 140 extends at least a portion of the length of the bottom support 106. In some embodiments, the rocker portion can extend between half of the length and three quarters of the length of the bottom support 106. In some embodiments, the rocker portion is at least half of the length of the bottom support. The rocker portion 140 can be generally shaped to allow for a rocking motion when a person is seated in the seat. The shape of the rocking portion 140 can be based on a defined radius of curvature. For example, a rocking portion may have a radius of curvature between 12 inches and 96 inches. A larger radius of curvature can provide for less rocking movement, whereas a smaller radius of curvature can provide for greater rocking movement in the rocking position. In some embodiments, the shape of the rocking portion may be a spline with no defined radius of curvature.

The curvature of the rocking portion 140 can smoothly transition into the curvature of the flat portion 142. The flat portion 142 is positioned in the rearward portion of the bottom portion 106 and can be substantially flat. The flat portion 142 can be substantially flat between the back end of the bottom support 106 and the transitional portion 144. The flat portion 142 functions as a stop to stabilize movement and limit further backward and forward rocking movement of the chair 100 when in a float position (also referred to as the flat position or zero gravity position).

The transitional portion 144 is configured to provide a pivot point for a person to move between a rocking position and a float position. The angle of the flat portion 142 relative to the rocking portion 140 can be configured so that when a person rocks the chair beyond the transitional portion 144 and onto the flat portion 142, the chair 100 can remain in the float position. A person can remain in the float position and rest on the flat portion 142 of the bottom portion with minimal effort. Preferably, the weight of the person is substantially centered above the flat portion so that the downward force holding the person in the chair is greater than the force pushing the person forward toward the rocking position. Additionally, the flat portion 142 functions to maintain the position of the person in place. In some configurations, the chair can rest on the flat portion with a person sitting without the person holding the chair in position with his legs. Preferably, when in the float position, the person actively rocks the chair forward in order to transition from the float position to the rocking position.

When in the rocking position, the person in the chair can rock in a back and forth motion. In order to move from the rocking position to the float position, the person can push the chair back until the chair rotates back past the transitional portion 144.

The amount of rocking and the angle at which the person can move between these positions can be controlled by the relative lengths and dimensions of the bottom portion 106. The amount of rocking can be dependent on the shape and curvature of the rocking section 140. The movement of the chair between the float position and the rocking position can be controlled by the positioning of the transitional portion 144. The positioning of the transitional portion 144 can be based on the predicted center of gravity of the person sitting in the chair. In this manner, the person using the chair rest on the flat portion 142 with minimal effort.

The ability to switch between a rocking position and a float position facilitates the ability of the chair 100 to be used with individuals having differing needs. In particular, given that the chair 100 comprises the seat portion 110 that is configured to be movable or tiltable the chair meets the needs of a population seeking greater freedom of movement when using a chair.

With reference now to FIGS. 9-13, additional embodiments of chairs are described in accordance with certain features, aspects, and advantages. Many of the features, aspects, and advantages of the embodiment of FIGS. 9-13 are similar to the embodiment of FIGS. 1-8. Accordingly, the following description focuses upon variations of embodiments that can use various aspects of the embodiments described above.

Figure 9:
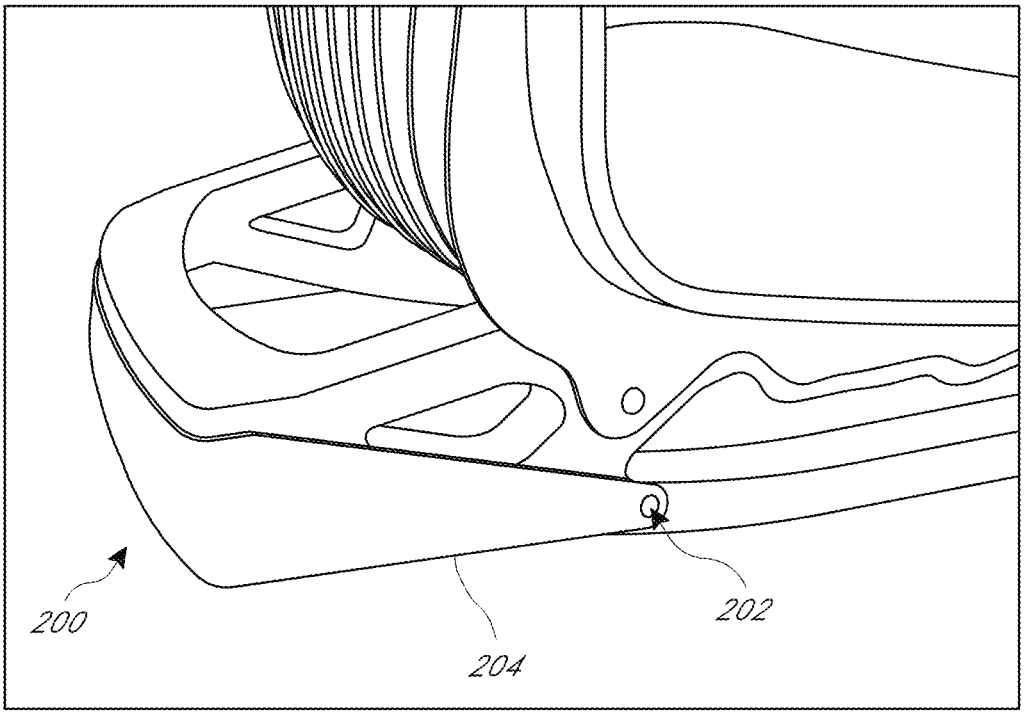
FIG. 9 is an embodiment of a rocking cover for an embodiment of a chair.

FIG. 9 illustrates an embodiment of a rocking cover 200 positioned on a backend of the bottom support, such as the bottom support 106. The rocking cover 200 can rotate about a pivot point 202. The rocking cover 200 can be rotatably coupled to the bottom support 106 at one or more pivot points using fasteners, rods, or other types of couplings. The rocking cover 200 may be formed from paper, plastic, or other types of materials. In some embodiments, the pivot point 202 can be positioned in substantially the same position as the transition portion 144. The rocking cover 200 can be configured to be positioned substantially on the floor independent of the position of the bottom support 106. For example, a bottom surface 204 of the rocking cover 200 can remain on the floor when the chair is rocking back and forth in the rocking position or in the float position. Regardless of the position of the chair 100, the rocking cover can block the upraised portion of the bottom support 106 in order to help prevent objects from being placed underneath the chair during the rocking motion. In some embodiments, a rocking cover 200 may be placed on the front end in addition to or in lieu of a rocking cover 200 placed on the back end of the bottom support 106.

Figure 10:
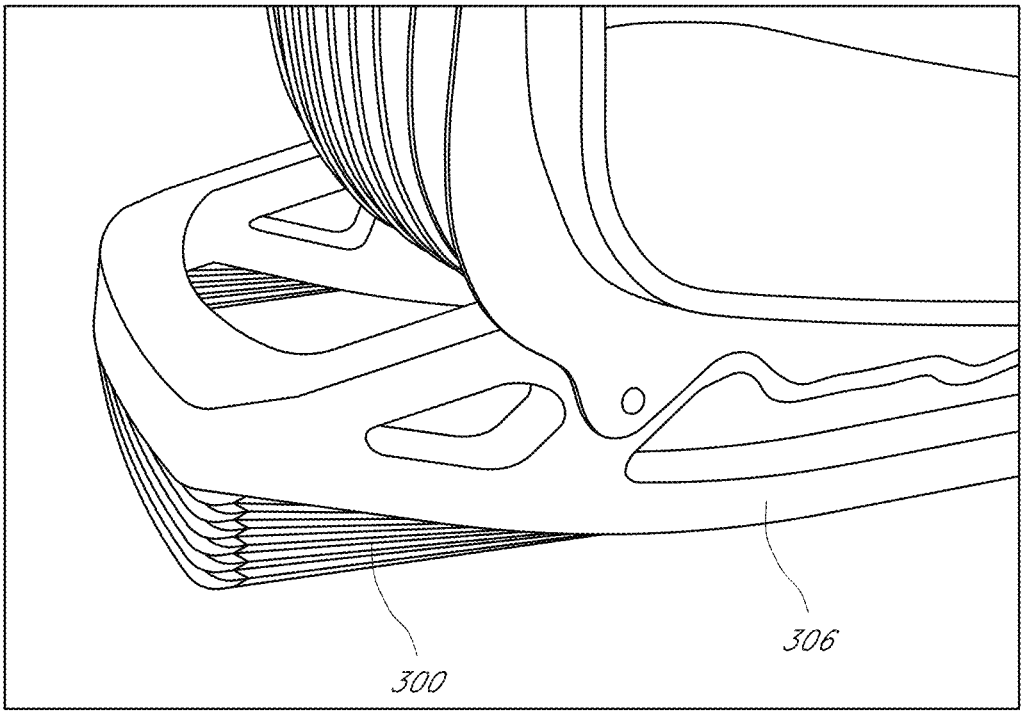
FIG. 10 is another embodiment of a rocking cover for an embodiment of a chair.
Figure 11:
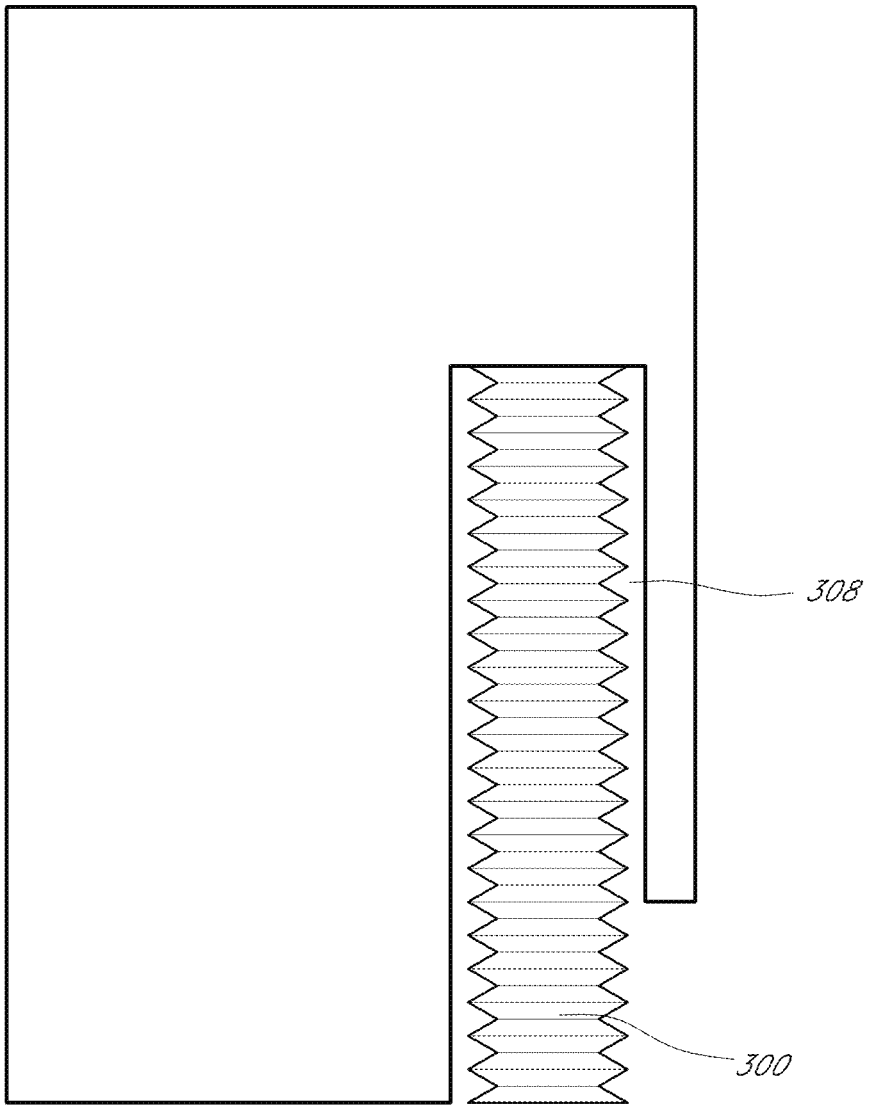
FIG. 11 is a cross-sectional view of a portion of the embodiment of the rocking cover and chair of FIG. 10.

FIGS. 10 and 11 illustrate another embodiment of a rocking cover 300 and another embodiment of a bottom support 306. In this embodiment, the rocking cover 300 is positioned within a cavity 308 formed in the frame of the bottom support 306. In this embodiment, the rocking cover 300 is an expandable membrane that can expand and contract within the cavity 308 of the bottom support 306. The expandable cover 300 can have a bellows type configuration that allows the cover 300 to extend from a top surface of the cavity 308 to the floor regardless of the position of the bottom support. In some embodiments, the cover 300 can have a weighed bottom edge or a rigid portion that maintains the position of the rocking cover on the floor regardless of the rocking position of the chair. The cover 300 can move independent of the motion of the chair such that it does not substantially inhibit the rocking motion of the chair. As described above, the rocking cover 300 can block access and help to prevent objects from being placed underneath the chair during rocking.

Figure 12:
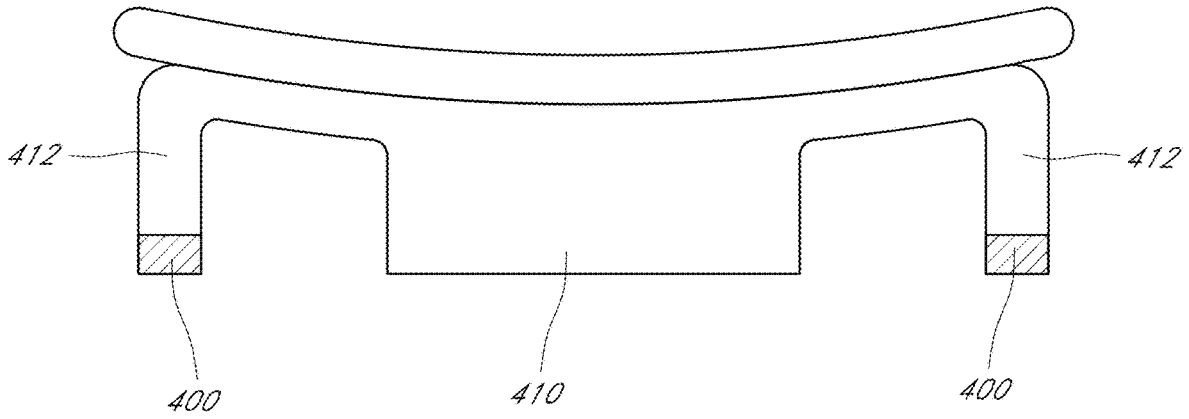
FIG. 12 is another embodiment of a chair with a rocking cover.

FIG. 12 illustrates another embodiment chair having combined bottom and intermediate portions. The chair includes a rocking cover 400. In the illustrated embodiment, the bottom and intermediate portions can be configured as a unitary piece. A middle portion 410 can be configured to bear the load of the person sitting in the chair. The middle portion can be sized and shaped to include a rocking portion and a flat portion. The side portions 412 can extend less than the total height of the middle portion 410. The side portions 412 can have substantially the same curvature of the middle portion 410. In some embodiments, the side portions 412 may have a profile the deviates at least partially from the curvature of the middle portion 410. The side portions can have collapsible covers 400, similar to the cover described with respect to FIGS. 10 and 11. A top side of the cover 400 can be affixed to a bottom surface of the side portion 412. The cover 400 can be configured to extend between the bottom surface and the floor regardless of the rocking position of the chair.

Figure 13:
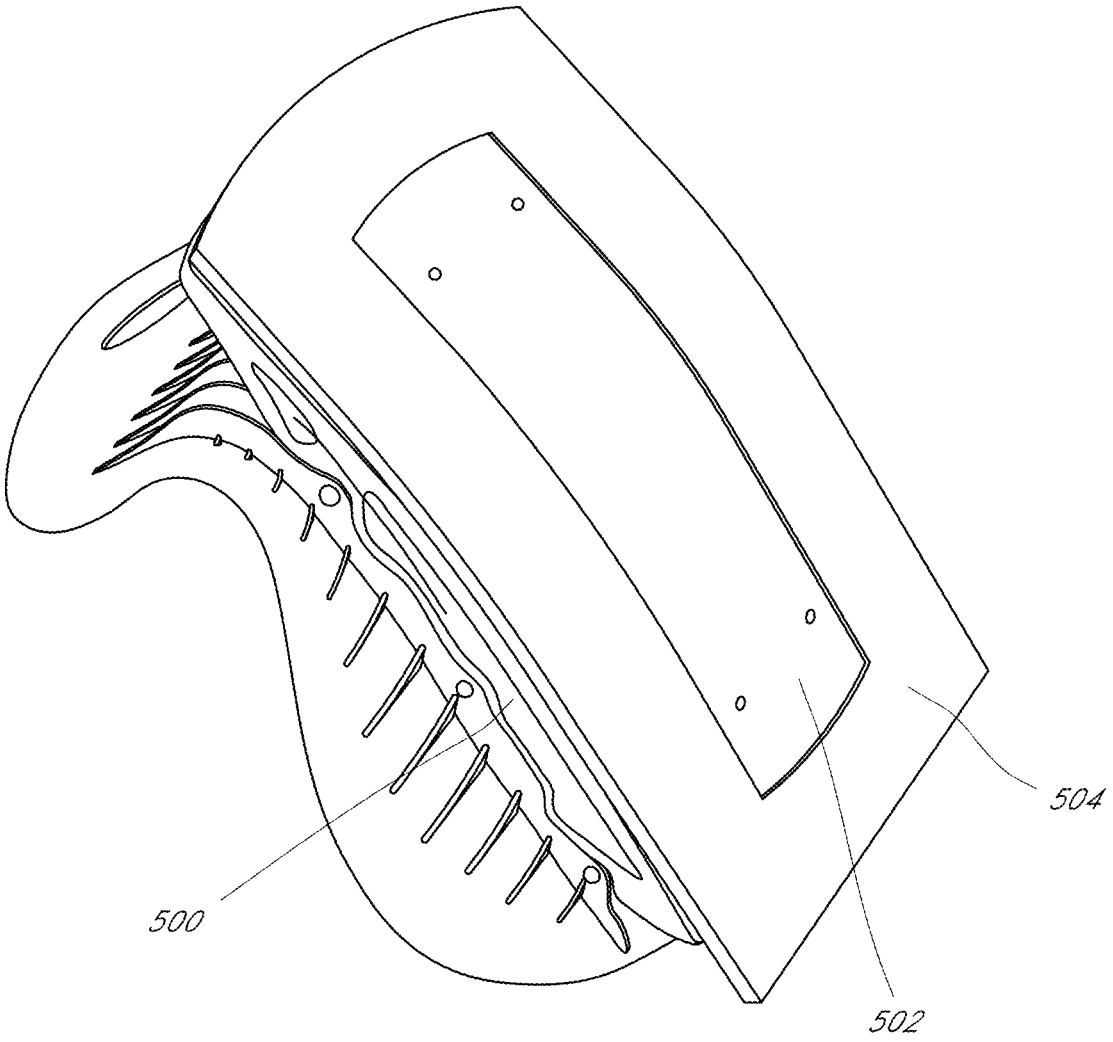
FIG. 13 is yet another embodiment of a chair.

FIG. 13 illustrates another embodiment of a bottom support 500 of the chair. In the illustrated embodiment, the rigid layer 502 of the bottom support 500 includes areas of different thicknesses. In the center portion, the rigid layer 502 extends the entire thickness of the bottom support 500. In the surrounding areas, the thickness of the rigid layer 502 is less than the total thickness of the bottom support. A resilient layer 504 covers the rigid layer and extends to substantially the same thickness as the thickness of the rigid layer in the center portion.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements, and/or states are in any way required for one or more embodiments or that one or more embodiments necessarily include these features, elements, and/or states.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

While the above detailed description may have shown, described, and pointed out novel features as applied to various embodiments, it may be understood that various omissions, substitutions, and/or changes in the form and details of any particular embodiment may be made without departing from the spirit of the disclosure. As may be recognized, certain embodiments may be embodied within a form that does not provide all of the features and benefits set forth herein, as some features may be used or practiced separately from others.

Additionally, features described in connection with one embodiment can be incorporated into another of the disclosed embodiments, even if not expressly discussed herein, and embodiments having the combination of features still fall within the scope of the disclosure. For example, features described above in connection with one embodiment can be used with a different embodiment described herein and the combination still fall within the scope of the disclosure.

It should be understood that various features and aspects of the disclosed embodiments can be combined with, or substituted for, one another in order to form varying modes of the embodiments of the disclosure. Thus, it is intended that the scope of the disclosure herein should not be limited by the particular embodiments described above. Accordingly, unless otherwise stated, or unless clearly incompatible, each embodiment of this disclosure may comprise, additional to its essential features described herein, one or more features as described herein from each other embodiment disclosed herein.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added.

Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately," "about," "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, 0.1 degree, or otherwise.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

Unless the context clearly requires otherwise, throughout the description and the claims, the words "comprise," "comprising," and the like, are to be construed in an inclusive sense as opposed to an exclusive or exhaustive sense, that is to say, in the sense of "including, but not limited to."

Reference to any prior art in this description is not, and should not be taken as, an acknowledgement or any form of suggestion that that prior art forms part of the common general knowledge in the field of endeavor in any country in the world.

The invention may also be said broadly to consist in the parts, elements and features referred to or indicated in the description of the application, individually or collectively, in any or all combinations of two or more of said parts, elements, or features.

Where, in the foregoing description, reference has been made to integers or components having known equivalents thereof, those integers are herein incorporated as if individually set forth. In addition, where the term "substantially" or any of its variants have been used as a word of approximation adjacent to a numerical value or range, it is intended to provide sufficient flexibility in the adjacent numerical value or range that encompasses standard manufacturing tolerances and/or rounding to the next significant figure, whichever is greater.

It should be noted that various changes and modifications to the presently preferred embodiments described herein will be apparent to those skilled in the art. Such changes and modifications may be made without departing from the spirit and scope of the invention and without diminishing its attendant advantages. For instance, various components may be repositioned as desired. It is therefore intended that such changes and modifications be included within the scope of the invention. Moreover, not all of the features, aspects, and advantages are necessarily required to practice the present invention. Accordingly, the scope of the present invention is intended to be defined only by the claims.

What is claimed is:

1. A chair comprising:

a seat component comprising a seat portion with a bottom surface and a back support portion, the seat portion and the back support portion comprising a uniform body;

a bottom support component formed having a monolithic platform structure, the monolithic platform structure comprising:

a rigid layer, the rigid layer comprising a rocking section, a flat section, and a transitional section, the rocking section having a defined curvature and extending between a front end of the bottom support component and the transitional section, the flat section having a substantially flat portion extending between a back end of the bottom support component and the transitional section; and a resilient layer covering at least a portion of the rigid layer, the resilient layer formed from a compressible material; and an intermediate support component joined to the seat component and comprising at least one support member, the at least one support member configured to interconnect the intermediate support with the seat component and the bottom support;

wherein the chair is configured to be selectively movable between a rocking position and a stop position, in the rocking position the chair is movable along the defined curvature of the rocking section, in the stop position the chair is configured to limit movement of the chair to the stop position, wherein the chair transitions between the rocking position and stop position by rotating past the transitional section of the bottom support.

2. The chair of claim 1, wherein the resilient layer, in an uncompressed state, is at least half of a total thickness of the rigid layer and the resilient layer.

3. The chair of claim 1 further comprising a coating layer covering at least a portion of the resilient layer.

4. The chair of claim 3, wherein the coating layer further comprising one or more elastomeric elements.

5. The chair of claim 3, wherein the coating layer is an elastomeric material.

6. The chair of claim 1, wherein the bottom support component is a unitary platform.

7. The chair of claim 1, wherein a thickness of the rigid layer varies across the bottom support component.

8. The chair of claim 1, wherein the intermediate support component and the rigid layer are formed as a unitary body.

9. The chair of claim 1, wherein the bottom support comprises a plurality of rails, each rail coupled to a corresponding support member of the intermediate support component, each rail comprising a rigid layer.

10. A chair having a seat portion that is capable of selectively moving between a rocking position and a stop position, the seat portion being joined to a bottom support formed having a monolithic platform structure, a resilient layer covering at least a portion of the monolithic platform structure, the resilient layer formed from a compressible material, the monolithic platform structure comprising a rocking section, a flat section, and a transitional section, the rocking section having a defined curvature and extending between a front end of the bottom support component and the transitional section, the flat section having a substantially flat portion extending between a back end of the bottom support component and the transitional section, in the rocking position the chair is movable along the defined curvature of the rocking section, in the stop position the chair is configured to limit movement of the chair to the stop position, wherein the chair transitions between the rocking position and stop position by rotating past the transitional section of the bottom support.

11. The chair of claim 10 further comprising an intermediate support component joined configured to join the seat portion to the bottom support.

12. The chair of claim 10 further comprising a coating layer covering at least a portion of the resilient layer.

13. The chair of claim 12, wherein the coating layer further comprising one or more elastomeric elements.

* * * * *